US007402185B2

(12) United States Patent
Aradi et al.

(10) Patent No.: US 7,402,185 B2
(45) **Date of Patent: *Jul. 22, 2008**

(54) ADDITIVES FOR FUEL COMPOSITIONS TO REDUCE FORMATION OF COMBUSTION CHAMBER DEPOSITS

(75) Inventors: Allen A. Aradi, Richmond, VA (US); Dennis J. Malfer, Glen Allen, VA (US); Scott D. Schwab, Richmond, VA (US); William J. Colucci, Glen Allen, VA (US)

(73) Assignee: Afton Chemical Intangibles, LLC, Richmond, VA (US)

( * ) Notice: Subject to any disclaimer, the term of this patent is extended or adjusted under 35 U.S.C. 154(b) by 403 days.

This patent is subject to a terminal disclaimer.

(21) Appl. No.: 10/397,772

(22) Filed: Mar. 26, 2003

(65) Prior Publication Data

US 2004/0010966 A1 Jan. 22, 2004

Related U.S. Application Data

(63) Continuation-in-part of application No. 10/128,529, filed on Apr. 24, 2002, now Pat. No. 6,866,690.

(51) Int. Cl.
*C10L 1/18* (2006.01)
*C10L 1/22* (2006.01)

(52) U.S. Cl. ..... 44/385; 44/408; 44/412

(58) Field of Classification Search ..... 44/408, 44/385, 412, 360
See application file for complete search history.

(56) References Cited

U.S. PATENT DOCUMENTS

| | | | | | |
|---|---|---|---|---|---|
| 2,433,243 | A | * | 12/1947 | Peters et al. | 44/408 |
| 3,030,195 | A | * | 4/1962 | Ewan | 44/359 |
| 3,055,746 | A | | 9/1962 | Eckert | |
| 3,429,673 | A | | 2/1969 | Reese et al. | |
| 3,442,630 | A | | 5/1969 | Annable et al. | |
| 3,658,707 | A | * | 4/1972 | Delafield | 508/306 |
| 3,785,790 | A | | 1/1974 | Strang | |
| 3,873,278 | A | | 3/1975 | Polss | |
| 3,996,024 | A | | 12/1976 | Coon | |
| 4,086,172 | A | | 4/1978 | Lowe | |
| 4,129,508 | A | | 12/1978 | Friihauf | |
| 4,141,693 | A | * | 2/1979 | Feldman et al. | 44/359 |
| 4,185,594 | A | | 1/1980 | Perilstein | |
| 4,204,481 | A | | 5/1980 | Malec | |
| 4,208,190 | A | | 6/1980 | Malec | |
| 4,211,534 | A | * | 7/1980 | Feldman | 44/394 |
| 4,231,883 | A | | 11/1980 | Malec | |
| 4,280,916 | A | | 7/1981 | Richards et al. | |
| 4,406,803 | A | | 9/1983 | Liston et al. | |
| 4,409,000 | A | | 10/1983 | LeSuer | |
| 4,427,562 | A | | 1/1984 | Horodysky et al. | |
| 4,428,182 | A | | 1/1984 | Allen et al. | |
| 4,512,903 | A | | 4/1985 | Schlicht et al. | |
| 4,581,039 | A | | 4/1986 | Horodysky | |
| 4,589,992 | A | | 5/1986 | Phillips et al. | |
| 4,617,026 | A | | 10/1986 | Schaub et al. | |
| 4,729,769 | A | | 3/1988 | Schlicht et al. | |
| 4,789,493 | A | | 12/1988 | Horodysky | |
| 4,808,196 | A | | 2/1989 | Horodysky | |
| 4,836,829 | A | | 6/1989 | Zimmerman et al. | |
| 4,867,752 | A | | 9/1989 | Braid et al. | |
| 4,869,728 | A | * | 9/1989 | Sung | 44/419 |
| 5,352,251 | A | * | 10/1994 | Lin et al. | 44/340 |
| 5,405,418 | A | * | 4/1995 | Ansarie et al. | 44/389 |
| 5,425,789 | A | | 6/1995 | Lewtas et al. | |
| 5,858,029 | A | | 1/1999 | Oumar-Mahamat et al. | |
| 5,968,211 | A | | 10/1999 | Schilowitz | |
| 6,086,645 | A | * | 7/2000 | Quigley et al. | 44/418 |
| 6,277,158 | B1 | | 8/2001 | McLean | |
| 6,328,771 | B1 | | 12/2001 | Moreton | |
| 6,866,690 | B2 | * | 3/2005 | Aradi et al. | 44/408 |
| 7,208,022 | B2 | * | 4/2007 | Corkwell et al. | 44/331 |
| 2002/0095858 | A1 | | 7/2002 | Krull et al. | |

FOREIGN PATENT DOCUMENTS

| | | |
|---|---|---|
| CA | 2 388 065 A1 | 5/2000 |
| CA | 2352705 | 5/2002 |
| DE | 1 021 525 | 12/1957 |
| DE | 1 645 886 | 6/1971 |
| EP | 0 303 862 A1 | 2/1989 |
| EP | 0 482 253 A1 | 4/1992 |
| EP | 0 798 364 A1 | 10/1997 |
| EP | 0 829 527 A1 | 3/1998 |

(Continued)

OTHER PUBLICATIONS

Australian Patent Office Service and Information Center, Written Opinion & Search Report, Mailed Oct. 19, 2006.

*Primary Examiner*—Cephia D Toomer
(74) *Attorney, Agent, or Firm*—John H. Thomas, PC

(57) ABSTRACT

A method for reducing the formation of combustion chamber deposits in an engine using a friction modifier for combustible fuels is provided. The friction modifier is prepared by combining a saturated carboxylic acid and an alkylated or alkoxylated amine. The particular selection of friction modifier enables a stable additive concentrate to be formulated providing a significant decrease in CCD without increasing the incidence of IVD deposits in combustion engines running on a fuel modified with the additive concentrate.

1 Claim, No Drawings

FOREIGN PATENT DOCUMENTS

| | | | |
|---|---|---|---|
| EP | 0 869 163 | A1 | 10/1998 |
| EP | 1295933 | A2 | 3/2003 |
| EP | 1 357 170 | A2 | 10/2003 |
| FR | 77 17792 | | 4/1979 |
| GB | 757753 | | 9/1956 |
| JP | 62768/78 | | 12/1979 |
| JP | 302660/94 | | 5/1996 |
| WO | WO98/11175 | A1 | 3/1998 |
| WO | WO 01/38463 | A1 | 5/2001 |
| WO | WO 01/72930 | A2 | 10/2001 |

* cited by examiner

ADDITIVES FOR FUEL COMPOSITIONS TO REDUCE FORMATION OF COMBUSTION CHAMBER DEPOSITS

This is a Continuation-in-Part patent application claiming the benefit of its parent with application Ser. No. 10/128,529, filed Apr. 24, 2002 now U.S. Pat. No. 6,866,690.

BACKGROUND OF THE INVENTION

This invention relates to a friction modifier additive for use in fuels, particularly in gasolines for internal combustion engines. The present invention further relates to new methods for controlling, i.e., reducing or eliminating, combustion chamber deposits in engines while imparting enhanced fuel economy performance.

Over the years considerable work has been devoted to additives for controlling (preventing or reducing) deposit formation in the fuel induction systems of spark-ignition internal combustion engines. In particular, additives that can effectively control fuel injector deposits, intake valve deposits and combustion chamber deposits represent the focal point of considerable research activities in the field and despite these efforts, further improvements are desired.

The major fuel-related deposit problem areas for PFI and DIG engines are injectors, intake valves, and the combustion chamber. Additionally, engine friction between piston and cylinder, the valve train, and the fuel pump result in increasing fuel consumption. In DIG engine technology in particular there is a friction related durability issue with the high-pressure pump (up to 1500 psi pumping capacity), which break down due to the inherently low lubricity of gasolines. There is, therefore, a desire in the petroleum industry to produce a fuel suitable for use in both PFI and DIG engines, that can address the engine deposit and frictional requirements outlined above.

As discussed at some length in U.S. Pat. No. 6,277,158 to McLean, the performance of gasolines and other fuels can be improved through the use of additive technology. For instance, detergents have been used to inhibit the formation of intake system deposits, and thereby improve engine cleanliness and performance. Regulatory mandates have required the introduction of low sulfur fuels, which are known to be less lubricating and raise concerns regarding the durability of fuel pumps and injectors. Sulfur itself is not directly known to be a lubricity modifying agent. However, removal of sulfur by deep hydrotreating is known to also inadvertently remove natural lubricity components of the fuel, such as certain aromatics, carboxylic acids, and esters. Unfortunately, commercial gasoline detergents and dispersants generally show very little friction reducing characteristics until very high concentrations of them are added to the fuel. These high detergent concentrations often reach levels where no-harm effects such as CCD become unacceptable.

It has been suggested that separate friction modifiers can be added to gasoline to increase fuel economy by reducing engine friction. Fuel friction modifiers would also serve to protect high-pressure fuel pumps and injectors such as those found in DIG engines from wear caused by fuel. Worldwide regulations calling for a steep reduction in fuel sulfur levels may exacerbate this wear problem even further. In selecting suitable components for a combined detergent/friction modifier additive package it is important to ensure a balance of detergent and friction modification properties, and so forth. Ideally, the friction modifier should not adversely affect the deposit control function of the detergent. In addition the additive package should not adversely effect on engine performance. For example, the additive package should not promote valve sticking or cause other performance-reducing problems. To be suitable for commercial use, the friction modifier additive also must pass all no-harm testing required for gasoline performance additives. This is often the biggest hurdle for commercial acceptance. The no-harm testing involves 1) compatibility with gasoline and other additives likely to be in gasoline at a range of temperatures, 2) no increase in IVD and CCD, 3) no valve stick at low temperatures, and 4) no corrosion in the fuel system, cylinders, and crankcase. Developing an additive meeting all these criteria is challenging.

Most prior friction modifiers for fuels have been derivatives of natural product (plant and animal derived) fatty acids, with only a few purely synthetic products. For example, WO 01/72930 A2 describes a mechanistic proposal for delivery of a fuel born friction modifier to the upper cylinder wall and into the oil sump resulting in upper cylinder/rings and valves lubrication. The friction modifier is packaged with fuel detergent dispersants such as polyetheramines (PEAs), polyisobutene amines (PIBAs), Mannich bases, and succinimides. Fuel friction modifier prior art identified in the WO '930 reference include U.S. Pat. Nos. 2,252,889, 4,185,594, 4,208,190, 4,204,481, and 4,428,182, which all describe use of fuel modifiers in diesel fuel. Chemistries covered by these patents include fatty acid esters, unsaturated dimerized fatty acids, primary aliphatic amines, fatty acid amides of diethanolamine and long-chain aliphatic monocarboxylic acids. Another specific mentioned patent therein is U.S. Pat. No. 4,427,562, which discloses a lubricant oil and fuel friction modifier made by reacting primary alkoxyalkylamines with carboxylic acids or by aminolysis of the appropriate formate ester, and also U.S. Pat. No. 4,729,769.

U.S. Pat. No. 4,729,769, describes a gasoline carburetor detergent for gasoline compositions derived from reaction products of a $C_6$–$C_{20}$ fatty acid ester, such as coconut oil, and a mono- or di-hydroxy hydrocarbyl amine, such as diethanolamine, as carburetor detergents. The additive in the '769 patent is described as being useful in any gasoline including leaded and those containing methylcyclopentadienyl manganese tricarbonyl (MMT). The fuel described in the '769 patent may contain other necessary additives such as anti-icers, and corrosion inhibitors.

U.S. Pat. No. 5,858,029 describes friction reducing additives for fuels and lubricants involving the reaction products of primary etheramines with hydrocarboxylic acids to give hydroxyamides that exhibit friction reduction in fuels and lubricants. Other prior patents describing friction modifiers include U.S. Pat. No. 4,617,026 (monocarboxylic acid of ester of a trihydric alcohol, glycerol monooleate as fuels and lubricant friction modifier); U.S. Pat. Nos. 4,789,493, 4,808,196, and 4,867,752 (use of fatty acid formamides); U.S. Pat. No. 4,280,916 (use of fatty acid amides); U.S. Pat. No. 4,406,803 (use of alkane 1,2-diols in lubricants to improve fuel economy); and U.S. Pat. No. 4,512,903 (use of amides from mono- or polyhydroxy substituted aliphatic monocarboxylic acids and amines). U.S. Pat. No. 6,328,771 discloses fuel compositions containing lubricity enhancing salt compositions made by the reaction of certain carboxylic acids with a component that is comprised of a heterocyclic aromatic amine. EP 0 798 364 discloses diesel fuel additives comprising a salt of a carboxylic acid and an aliphatic amine, or an amide obtained by dehydration-condensation between a carboxylic acid and an aliphatic amine.

EP 0 869 163 A1 describes a method for reducing engine friction by use of ethoxylated amines. In addition, U.S. Pat. No. 4,086,172 (oil soluble hydroxyamines such as "ETH- OMEEN 18–12™" formula $C_{18}H_{37}N—(CH_2CH_2OH)_2$ as lubricant antioxidant); U.S. Pat. No. 4,129,508 (reaction products of succinic acid or anhydride and a polyalkylene glycol or monoether, an organic basic metal, and an alkoxylated amine as a demulsifier); U.S. Pat. Nos. 4,231,883; 4,409,000; and 4,836,829, all teach various uses of hydroxyamines in fuels and lubricants.

U.S. Pat. No. 6,277,158 describes the current practice in the supply of gasoline as generally being to pre-mix the fuel additives into a concentrate in a hydrocarbon solvent base, and then to inject the concentrate into gasoline pipelines used to fill tankers prior to delivery to the customer. To facilitate injection of the concentrate into the gasoline, it is important that the concentrate is in the form of a low viscosity, homogeneous liquid.

A friction modifier may be added to the gasoline as the lone additive or in combination with a detergent dispersant package that is fully formulated for fuel compatibility at conditions likely to be experienced by the engine. In addition, a need may exist for a detergent/friction modifier additive concentrate for gasoline that provides all of fuel economy enhancement, combustion chamber deposit control and friction reduction. In addition it should be stable over the temperature range at which the concentrate may feasibly be stored, and which does not adversely affect the performance and properties of the finished gasoline or engine in which the gasoline is used, and in particular, does not lead to increased IVD or CCD problems.

SUMMARY OF THE INVENTION

The present invention provides a method for reducing the formation of CCD in an engine. The method employs the use in the engine of a friction modifier prepared by combining a saturated branched or linear carboxylic acid and an amine, such as ammonia or an alkylated or alkoxylated amine.

As used herein, the term "alkylated" is generic in that it can mean monoalkylated, or polyalkylated (such as "dialkylated"). The term "amine," as used in connection with the friction modifier is generic in that it can mean ammonia, monoamine, or polyamine (such as "diamine").

In one preferred aspect, the friction modifier comprises branched saturated carboxylic acid salt of a mono- or di-alkylated amine. In another preferred aspect, the friction modifier comprises an alkylamine isostearate. It also will be appreciated that the friction modifier and any detergent package are not necessarily identical materials.

As used herein, the term "alkoxylated" or "alkoxy" is generic in that it can mean monoalkoxylated, or polyalkoxylated (such as "dialkoxylated"). The term "amine," as used in connection with the friction modifier, is generic in that it can mean monoamine, or polyamine (such as "diamine"). In one preferred aspect, the friction modifier comprises branched saturated carboxylic acid salt of a mono- or di-alkoxylated amine. In another preferred aspect, the friction modifier comprises an alkoxyamine isostearate or etheramine isostearate.

As used herein, the terms "alkoxylated amine" and "etheramine" can mean a primary, secondary or tertiary amine that has at least (a) one —OR alkoxy group, where R is an aliphatic hydrocarbon of $C_1$–$C_{28}$, or (b) one R—O—R' ether group where R and R' are independently aliphatic hydrocarbons of $C_1$–$C_{28}$.

When incorporated into an engine fuel, the friction modifier of the present invention is included in an amount effective such that the engine running on the fuel has significantly reduced formation of combustion chamber deposits.

In one particular aspect, the present invention utilizes an additive concentrate for use in combustion engine fuels comprising, by weight based on the total weight of the concentrate:

(a) 0.2 to 50% friction modifier comprising of a branched or linear saturated carboxylic acid salt of ammonia or a mono- or di-alkylated amine or mono- or dialkoxylated amine, which preferably is a liquid or can be solubilized at room temperature and pressure;

(b) 40 to 99.8% detergent package mainly comprised of a detergent and carrier mix; and (c) 0 to 80% solvent.

In one example of the invention, the friction modifier is n-butylamine isostearate or a branched saturated isomer thereof, or mixtures thereof. In another example, the friction modifier is the salt formed by combining isodecyloxypropylamine with isostearic acid. Also, the friction modifier can be ashless or ash-producing, and in a preferred embodiment is ashless.

In one aspect, the particular selection of a branched or linear saturated carboxylic acid salt of ammonia or an alkylated or alkoxylated amine, in combination with a detergent package, enables a stable additive concentrate to be formulated having a friction modifier effective to achieve a significant benefit in friction loss, and hence an improvement in fuel economy, yet without leading to an increase in CCD. In one aspect, the CCD is significantly reduced by the present invention.

It is surprising and unexpected herein that CCD can be reduced without harmful impact in IVD and/or fuel economy.

In one preferred embodiment, the friction modifier as defined herein comprises a mixture of different monoamine salts having different respective fatty acid moieties with different length backbones and variable degrees of branching. Such mixtures of friction modifier species can further lower the melting point of that additive ingredient, providing a friction modifying component more prone to be in a liquid. The preferred friction modifier is typically a liquid over at least the temperature range of about −20° C. to about +35° C.

It has been found that the friction modifier comprising a branched or linear saturated carboxylic acid salt of ammonia or an alkylated or alkoxylated amine provides all the benefits explained above, while comparison compounds such as n-butylamine oleate in particular, when used in combination with a detergent, undesirably lead to increases in the incidence of IVD. While not desiring to be bound to a theory, it nonetheless is postulated that provision of a saturated fatty acid moiety in the friction modifier compound in accordance with the present invention helps in not interfering with the desired CCD control mechanisms sought when using fuels modified with the additive concentrate containing the friction modifier and detergent, while imparting the separately desired friction modification functionality and reduced CCD.

The provision of structural branching in the polyalkylene backbone of the fatty acid moiety of a branched saturated carboxylic acid salt of an alkylated or alkoxylated amine used as the friction modifier in the practice an embodiment of the present invention has been found important to increase the likelihood that the saturated friction modifier additive compound remains fluid and easily miscible with fuels at normal operating temperatures. However, solubilizing agents, for example hydrocarbon solvents such as alcohols or organic acids, may be included if desired or needed to help solubilize a solid form of a friction modifier, such as a linear saturated carboxylic acid, and therefore are not excluded from the scope of the present invention, although the solubilizing agents are not an essential requirement.

Further, this invention is also directed to methods of increasing fuel efficiency while controlling CCD and IVD deposits in gasoline engines. In another embodiment, the inventive composition of matter is provided as an aftermarket or "top treat" fuel additive composition.

DETAILED DESCRIPTION OF THE PREFERRED EMBODIMENTS

The present invention is directed in an embodiment to the reduction in CCD in an engine by administering to the engine a friction modifier prepared by the reaction, mixing or combination of a saturated linear, or more preferably, branched carboxylic acid and ammonia or an alkylated or alkoxylated amine. In one exemplary aspect, the friction modifier is prepared by the reaction, mixing or combination of (i) a saturated carboxylic acid, and (ii) a monoalkylated monoamine, or a dialkylated monoamine, (iii) a monoalkoxylated monoamine, (iv) a dialkoxylated monoamine, or any diamine or polyamine analogue thereof, or a combination or mixture thereof. In one preferred aspect, the saturated branched fatty acid used in the preparation of the friction modifier is an isostearic acid.

When this friction modifier is used in combination with a detergent package for fuels combusted in engines having intake valves, a remarkable performance enhancement effect is provided combining fuel economy improvements, and reduced CCD without increasing IVD. For instance, saturated and branched or linear carboxylic acid salts of an alkylated or alkoxylated monoamine are friction modifiers found by the present investigators to show especially excellent gasoline fuel economy enhancing properties through, for example, 1) the lowering of the boundary friction coefficient of the thin lubricating oil film on the upper cylinder walls of the engine, and 2) the lowering of IVD and CCD when used in combination with a detergent or deposit inhibitor to levels lower than those of the deposit inhibitor alone. They also may exhibit superior demulse capabilities.

Friction Modifier

The friction modifier used in the present invention, in a preferred embodiment, comprises a saturated branched or linear mono-, di- or polycarboxylic acid salt of ammonia or a monoalkylated, dialkylated, polyalkylated or monoalkoxylated, dialkoxylated or alkoxylated amine. In a more preferred embodiment, branching is included in the backbone of the saturated carboxylic acid to enhance compatibility with fuels at low ambient temperatures.

More specifically, the carboxylic acids useful herein can include, but are not limited to, isostearic, 2-ethyl hexanoic, lauric, palmitic, stearic, decanoic, dodecanoic, undecanoic, myristic, capric, caproic, caprylic, methylvaleric, dimethylvaleric, and isomers and mixtures thereof. In addition, other carboxylic acids useful herein can be alkyl acids in which the alkyl group is cyclic, referred to herein as cyclic carboxylic acids.

In addition, the carboxylic acid used in the present invention can be a monocarboxylic acid, a dicarboxylic acid, a poly carboxylic acid, or a mixture thereof.

A non-limiting structural representation of a suitable branched or linear saturated carboxylic acid salt of an alkylated or alkoxylated amine is the following general structural formula I:

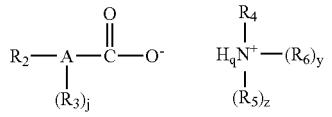

(I)

where $R_2$ and $R_3$ each independently represents an alkyl group, preferably a $C_1$–$C_6$ alkyl group, and more preferably methyl; j is 1 to 20, preferably 1 to 5; A represents —$CH_2)_x$— where x is 4 to 20; with the provisos that each $R_3$ is substituted for a hydrogen of a backbone carbon atom in A and no more than two $R_3$ groups are bonded to any given one backbone carbon atom in A; $R_4$, $R_5$ and $R_6$ each independently represents a hydrocarbyl group, such as an alkyl or alkoxy group, or a hydrogen atom; and q is 1, 2 or 3, and z and y each independently is 0 or 1, with the proviso that q is 3 where z and y each is 0, q is 2 when one of z or y is 1 and the other is 0, and q is 1 when z and y each is 1. In an embodiment, A or $R_2$ can independently be a cyclic hydrocarbon group.

In one further embodiment, $R_4$ and $R_5$ in structure I each independently represent an aliphatic $C_1$–$C_8$ alkyl or alkoxy group, which can be straight, cyclic, branched, nonsubstituted, or substituted, and with the proviso that any branching or substitution(s) present does not render it incompatible with the modified fuel composition. In one particular embodiment, $R_4$ and $R_5$ each independently represents a nonhydroxylated, aliphatic $C_1$–$C_8$ alkyl or alkoxy group. In a further aspect, $R_2$ and $R_3$ in structure I each can independently represent an aliphatic $C_1$–$C_6$ alkyl group, which can be straight, branched, cyclic, nonsubstituted, or substituted, and with the proviso that any branching or substitution(s) present does not render it incompatible with the modified fuel composition. An example of a cyclic amine useful herein is piperidine.

The branched or linear saturated carboxylic acid salt of ammonia or an alkylated or alkoxylated amine used as friction modifiers in this invention can be made, for example, by mixing (i) a branched or linear saturated carboxylic acid, or mixtures thereof, with (ii) a mono- and/or di-alkylated or alkoxylated monoamine, and/or a mono- and/or di-alkylated or alkoxylated polyamine, at an approximately 1:1 molar ratio, and with stirring at temperatures ranging from 25° C. to 75° C., until there is no further temperature change.

Mixtures of friction modifiers as defined herein having different back bone lengths and variable degrees of branching can be advantageously used as the friction modifier component. Such mixtures can further lower the melting point of the additive ingredient, providing a friction modifying component more prone to be in a liquid state, Also, the alkylated amine moiety of the friction modifier compound of structure I can be, for example, a monoalkyl monoamine moiety such as an n-butyl amine moiety, or, alternatively, a dialkyl monoamine moiety such as a di-n-butyl amine moiety.

Also, the alkoxylated amine moiety of the friction modifier compound of structure I can be, for example, Isohexyloxypropylamine
2-ethylhexyloxypropylamine
Octyl/Decyloxypropylamine
Isodecyloxypropylamine
Isododecyloxypropylamine
Isotridecyloxypropylamine
$C_{12-15}$ alkyloxypropylamine
Isodecyloxypropyl-1,3-diaminopropane
Isododecyloxypropyl-1,3-diaminopropane Isotridecyloxypropyl-1,3-diaminopropane
Isohexyloxypropylamine
2-ethylhexyloxypropylaamine
Octyl/Decyloxypropylamine
Isodecyloxypropylamine
Isopropyloxypropylamine
Tetradecyloxypropylamine
Dodecyl/tetradecyloxypropylamine
Tetradecyl/dodecyloxypropylamine
Octadecyl/hexadecyloxypropylamine As an exemplary friction modifier component (a), there is n-butylamine isostearate, which has the general formula: $(CH_3)_2CH(CH_2)_{14}C(O)O^{-+}NH_3C_4H_9$.

N-butylamine isostearate can be used as the friction modifier as well as saturated branched isomers thereof. An exemplary non-limiting structural representation of n-butylamine isostearate is the following structure II:

(II)

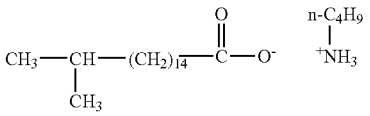

The n-butylamine isostearate, as described above, can be made by mixing n-butylamine and isostearic acid at about a 1:1 molar ratio, and stirring at temperatures ranging from 25° C. to 75° C. until there is no further temperature change.

Another example is isodecyloxypropylamine isostearate. Yet other examples are ammonium isostearate and ammonium stearate.

The treat level of the friction modifier in the finished gasoline generally will be an amount providing the improved performance and reduced CCD effects, such an in terms of improving fuel efficiency, and so forth, as described herein. For example, a treat level of at least about 5 PTB (pounds per thousand barrels), and more preferably at least about 50 PTB, of the friction modifier can be used for gasolines.

The friction modifier component (a) can be used as a relatively pure form of branched saturated carboxylic acid salts of an alkylated alkoxylated amine, or optionally in the co-presence of other branched carboxylic acid salts of alkylated or alkoxylated amines having an iodine number less than 10, as long as the latter do not adversely affect the desired performance characteristics of this additive, as identified herein.

Gasoline Performance Additive (GPA) Package

A traditional GPA package is generally comprised of a detergent package that mainly comprises a detergent and a carrier mix whose primary purpose is to keep the components parts of the engine free of deposits. Other components present in the GPA package typically include a corrosion inhibitor, a demulsifying agent, antioxidants and solvents. In some cases a marker is added to the GPA package for identification. Thus, the detergent package typically is introduced to the fuel additive concentrate as part of a GPA package, although this is not required.

Detergent (Deposit Inhibitor) Package

The detergent or deposit inhibitor used in the detergent package component of an embodiment of the additive concentrate described herein may include any suitable commercially available detergent or deposit inhibitor available for this function. Deposit inhibitors for gasoline, usually referred to as detergents or dispersants, are well known and a variety of compounds can be used. Examples include Mannich bases, polyalkylene amines, and polyalkylene succinimides where the polyalkylene group typically has a number average molecular weight of from 600 to 2000, preferably from 800 to 1400, and polyether amines. A preferred detergent for the additive concentrate of the present invention is a Mannich base detergent.

The Mannich base detergents suitable for use in the present invention include the reaction products of a high molecular weight alkyl-substituted hydroxyaromatic compound, aldehydes and amines. The alkyl-substituted hydroxyaromatic compound, aldehydes and amines used in making the Mannich reaction products of the present invention may be any such compounds known and applied in the art.

Suitable Mannich detergents for use in the present invention include those detergents taught in U.S. Pat. Nos. 4,231,759; 5,514,190; 5,634,951; 5,697,988; 5,725,612; and 5,876,468, the disclosures of which are incorporated herein by reference. Suitable Mannich base detergents also include, for example, HiTEC® 4995 and HiTEC® 6410 Detergents and are available from the Ethyl Corporation, Richmond, Va., U.S.A.

The fuel composition in the present invention can further comprises a material selected from the group consisting of Mannich detergents, polyetheramine detergents, polyisobutylene detergents, succinimide detergents, and imidazoline detergents.

Carrier

In a preferred embodiment, the detergents are preferably used with a carrier or induction aid. This carrier typically will be a carrier fluid. Such carriers can be of various types, such as, for example, liquid poly-α-olefin oligomers, mineral oils, liquid poly(oxyalkylene) compounds, polyalkenes, and similar liquid carriers. Mixtures of two or more such carriers can also be employed.

Optional Solvent

Among other things, the kinematic viscosity of the additive concentrate can be adjusted (reduced) by solvent addition, if desired or needed. To achieve this, a solvent can be added to the concentrate, such as an aromatic hydrocarbon solvent or an alcohol. Examples include toluene, xylene, tetrahydrofuran, isopropanol isobutylcarbinol, n-butanol, and petroleum hydrocarbon solvents such as solvent naphtha, and the like.

Fuel Compositions

The fuel compositions of the present invention may contain supplemental additives in addition to deposit control additives described above. Said supplemental additives include dispersants/detergents, antioxidants, carrier fluids, metal deactivators, dyes, markers, corrosion inhibitors, biocides, antistatic additives, drag reducing agents, demulsifiers, emulsifiers, dehazers, anti-icing additives, antiknock additives, octane enhancers, anti-valve-seat recession additives, lubricity additives, surfactants and combustion improvers. Particularly preferred supplemental additives include methyl cyclopentadienyl manganese tricarbonyl, known as MMT, and or manganese-containing gasoline additives.

In another aspect, the present invention provides a fuel composition comprising combustible fuel and from 50 to 2500 ppm by weight of an additive combination comprising components (a), (b), and optionally a solvent (c), as described herein.

The combustible fuel used in the fuel composition of this invention is generally a petroleum hydrocarbon useful as a fuel, e.g., gasoline, for internal combustion engines. Such fuels typically comprise mixtures of hydrocarbons of various types, including straight and branched chain paraffins, olefins, aromatics and naphthenic hydrocarbons, and other liquid hydrocarbonaceous materials suitable for spark ignition gasoline engines.

These compositions are provided in a number of grades, such as unleaded and leaded gasoline, and are typically derived from petroleum crude oil by conventional refining and blending processes such as straight run distillation, thermal cracking, hydrocracking, catalytic cracking and various reforming processes. Gasoline may be defined as a mixture of liquid hydrocarbons or hydrocarbon-oxygenates having an initial boiling point in the range of about 20 to 60° C. and a final boiling point in the range of about 150 to 230° C., as determined by the ASTM D86 distillation method. The gasoline may contain other combustibles such as alcohol, for example methanol or ethanol.

The combustible fuels used in formulating the fuel compositions of the present invention preferably include any combustible fuels suitable for use in the operation of gasoline engines such as leaded or unleaded motor gasolines, and so-called reformulated gasolines which typically contain both hydrocarbons of the gasoline boiling range and fuel-soluble oxygenated blending agents ("oxygenates"), such as alcohols, ethers and other suitable oxygen-containing organic compounds. Preferably, the fuel is a mixture of hydrocarbons boiling in the gasoline boiling range. This fuel may consist of straight chain or branch chain paraffins, cycloparaffins, olefins, aromatic hydrocarbons or any mixture of these. The gasoline can be derived from straight run naptha, polymer gasoline, natural gasoline or from catalytically reformed stocks boiling in the range from about 80° to about 450° F. The octane level of the gasoline is not critical and any conventional gasoline may be employed in the practice of this invention.

Oxygenates suitable for use in the present invention include methanol, ethanol, isopropanol, t-butanol, mixed $C_1$ to $C_5$ alcohols, methyl tertiary butyl ether, tertiary amyl methyl ether, ethyl tertiary butyl ether and mixed ethers. Oxygenates, when used, will normally be present in the base fuel in an amount below about 85% by volume, and preferably in an amount that provides an oxygen content in the overall fuel in the range of about 0.5 to about 5 percent by volume.

The additives used in formulating the preferred fuels of the present invention can be blended into the base fuel individually or in various sub-combinations.

The friction modifier additive according to the present invention can be used generally in internal combustion engines that burn liquid fuel, especially spark-ignited gasoline engines that are carbureted, port-fuel injected (PFI), and direct injected gasoline (DIG). A preferred embodiment of the present invention comprises a method for controlling engine deposits. This is achieved by introducing into the engine fuel composition a) a spark-ignition fuel and b) a deposit inhibitor package/friction modifier additive as described herein which has been dispersed therein.

EXAMPLES

The practice and advantages of this invention are demonstrated by the following examples, which are presented for purposes of illustration and not limitation.

Test Samples Preparation

For purposes of the following examples, a number of different friction modifiers were tested either as a 5% solution in a 5W30 GF-3 test oil for boundary friction measurements, or in combination with the detergent HiTEC® 6421 for Sequence VI-B fuel economy engine tests and IVD and CCD measurements. HiTEC® 6421 Gasoline Performance Additive (GPA) is commercially available from Ethyl Corporation, Richmond, Va., U.S.A. For the Sequence VI-B engine fuel economy testing described in the examples below, the friction modifier/GPA combinations were formulated to contain (a) 50 PTB friction modifier, and (b) 80.9 PTB of HiTEC® 6421 GPA as the detergent source.

An example of a friction modifier (FM) additive representing the present invention is n-butylamine salt of Century 1101 V, which is a mixture of branched saturated fatty acids derived from vegetable oil. This salt is referred to as FM-1. A second example (FM-2) of the inventive salt is the n-butylamine salt of Century 1101P, which is a mixture of branched saturated fatty acids derived from pine oil. A third example of the salt of the present invention is FM-3, the isostearic acid salt of n-butylamine salt. Also useful as acids in the present invention are the materials obtained from the hydrogenation of animal-based sources of fatty acids and/or oligomers. As a comparison, n-butylamine oleate, which is outside the scope of the present invention, instead was used in the same wt % proportion in place of n-butylamine isostearate to demonstrate the CCD control superiority of the invention. The mixture of branched saturated fatty acids was obtained from Arizona Chemical under the generic product name Century 1101.

Comparative example FM-4 was the ammonium salts of mono-unsaturated oleic acid/iso-linoleic acid mix (37% and 46%, respectively, remainder is stearic acid). This is available as Century® MO-5N from Arizona Chemical.

CCD measurements were carried out on a Ford 2.3 L engine according to a modified version of the ASTM procedures to compare the FM-1, FM-2 and FM-3 additives. CCD levels from the combustion of fuels containing 80.9 PTB of the Mannich detergent (and carrier fluid) supplied as HiTEC® 6421 GPA, with 50 PTB friction modifier FM-1, and, separately, with 50 PTB FM-2 and FM-3, were measured. The results are summarized in Table 1.

TABLE 1

| Additive Formulation | Combustion Chamber Deposit (CCD) in mg |
|---|---|
| Mannich Detergent (A) | 1613 |
| (A) + FM-1 (invention) | 1443 |
| (A) + FM-2 (invention) | 1460 |
| (A) + FM-3 (invention) | 1416 |
| (A) + FM-4 (comparative) | 1721 |

The results are also illustrated in Table 1, which shows the significantly better CCD control and deposit reduction achieved with the fuel composition containing the n-butylamine salts of the saturated carboxylic acids (FM-1, FM-2 and FM-3) and detergent combination, as compared to the fuel compositions containing the unsaturated additives (FM-4) combined with the same type of detergent.

The invention also indicates that both n-butylamine isostearate of the invention and n-butylamine oleate of the prior art function as friction modifiers for gasoline, but that the use of fuel additives containing both a detergent and the n-butylamine isostearate results in decreased occurrence of CCD, while the use of fuel additives containing the detergent in combination with n-butylamine oleate results in an undesirable increase in the occurrence of CCD.

It is to be understood that the reactants and components referred to by chemical name anywhere in the specification or claims hereof, whether referred to in the singular or plural, are identified as they exist prior to coming into contact with another substance referred to by chemical name or chemical type (e.g., base fuel, solvent, etc.). It matters not what chemical changes, transformations and/or reactions, if any, take place in the resulting mixture or solution or reaction medium as such changes, transformations and/or reactions are the natural result of bringing the specified reactants and/or components together under the conditions called for pursuant to this disclosure. Thus the reactants and components are identified as ingredients to be brought together either in performing a desired chemical reaction (such as a Mannich condensation reaction) or in forming a desired composition (such as an additive concentrate or additized fuel blend). It will also be recognized that the additive components can be added or blended into or with the base fuels individually per se and/or as components used in forming preformed additive combinations and/or sub-combinations. Accordingly, even though the claims hereinafter may refer to substances, components and/or ingredients in the present tense ("comprises", "is", etc.), the reference is to the substance, components or ingredient as it existed at the time just before it was first blended or mixed with one or more other substances, components and/or ingredients in accordance with the present disclosure. The fact that the substance, components or ingredient may have lost its original identity through a chemical reaction or transformation during the course of such blending or mixing operations is thus wholly immaterial for an accurate understanding and appreciation of this disclosure and the claims thereof.

As used herein the term "fuel-soluble" or "gasoline-soluble" means that the substance under discussion should be sufficiently soluble at 20° C. in the base fuel selected for use to reach at least the minimum concentration required to enable the substance to serve its intended function. Preferably, the substance will have a substantially greater solubility in the base fuel than this. However, the substance need not dissolve in the base fuel in all proportions.

At numerous places throughout this specification, reference has been made to a 20 number of U.S. Patents. All such cited documents are expressly incorporated in full into this disclosure as if fully set forth herein.

This invention is susceptible to considerable variation in its practice. Therefore the foregoing description is not intended to limit, and should not be construed as limiting, the invention to the particular exemplifications presented hereinabove. Rather, what is intended to be covered is as set forth in the ensuing claims and the equivalents thereof permitted as a matter of law.

What is claimed is:

1. A method for reducing the formation of combustion chamber deposits in an internal combustion engine having a combustion chamber, said method comprising combusting in said internal combustion engine a fuel composition comprising a hydrocarbonaceous fuel and a friction modifier, wherein the friction modifier is prepared by combining an amine selected from the group consisting of Isohexyloxypropylamine; 2-ethylhexyloxypropylamine; Octyl/Decyloxypropylamine; Isodecyloxypropylamine; Isododecyloxypropylamine; Isotridecyloxypropylamine; $C_{12-C15}$ alkyloxypropylamine; Isodecyloxypropyl-1,3-diaminopropane; Isododecyloxypropyl-1,3-diaminopropane; Isotridecyloxypropyl-1,3-diaminopropane; 2-ethylhexyloxypropyl amine; Isopropyloxypropylamine; Tetradecyloxypropylamine; Dodecyl/tetradecyloxypropylamine me; Tetradecyl/dodecyloxypropylamine; Octadecyl/hexadecyloxypropylamine; Tetradecyloxypropyl-1,3-diaminopropane; and $C_{12}$–$C_{15}$ alkyloxypropyl-1,3-diaminopropane with a saturated carboxylic acid, whereby the formation of combustion chamber deposits in said engine is reduced relative to the formation of combustion chamber deposits in said engine combusting a fuel composition not containing said friction modifier.

* * * * *